US010343004B2

(12) United States Patent
Male

(10) Patent No.: US 10,343,004 B2
(45) Date of Patent: Jul. 9, 2019

(54) TRAMPOLINE SUPPORT HANDLE SYSTEMS

(71) Applicant: Andrew William Male, Sutton Coldfield (GB)

(72) Inventor: Andrew William Male, Sutton Coldfield (GB)

( * ) Notice: Subject to any disclaimer, the term of this patent is extended or adjusted under 35 U.S.C. 154(b) by 210 days.

(21) Appl. No.: 15/329,488

(22) PCT Filed: Oct. 17, 2014

(86) PCT No.: PCT/GB2014/000423

§ 371 (c)(1),
(2) Date: Jan. 26, 2017

(87) PCT Pub. No.: WO2016/024071

PCT Pub. Date: Feb. 18, 2016

(65) Prior Publication Data

US 2017/0216648 A1 Aug. 3, 2017

(30) Foreign Application Priority Data

Aug. 15, 2014 (GB) ..... 1414493.5

(51) Int. Cl.
*A63B 5/11* (2006.01)
*A63B 71/02* (2006.01)

(52) U.S. Cl.
CPC ..... *A63B 5/11* (2013.01); *A63B 71/023* (2013.01); *A63B 2208/02* (2013.01); *A63B 2210/50* (2013.01); *A63B 2225/093* (2013.01)

(58) Field of Classification Search
CPC ... A63B 5/11; A63B 21/4027; A63B 21/4033; A63B 21/4034; A63B 26/00;
(Continued)

(56) References Cited

U.S. PATENT DOCUMENTS 4,225,131 A * 9/1980 Sidlinger ..... A63B 5/11 482/27
4,337,942 A * 7/1982 Sidlinger ..... A63B 5/11 482/142
(Continued)

FOREIGN PATENT DOCUMENTS

CN 201006221 1/2008
DE 20 2014 007 636 12/2014
(Continued)

OTHER PUBLICATIONS

Great Britain Search Report dated Mar. 4, 2015 issued in Great Britain Patent Application No. 1414493.5, 2 pp.
(Continued)

*Primary Examiner* — Gary D Urbiel Goldner
(74) *Attorney, Agent, or Firm* — Nixon & Vanderhye P.C.

(57) ABSTRACT

A trampoline support handle system with which a trampoline, in particular a mini or smaller trampoline version, can be held in place during use by inserting existing legs of the trampoline into hollow tubes mounted on a frame of the system that seats underneath the trampoline on a floor. The system also includes an additional hollow tube into which an extendable and height adjustable long handle bar is inserted for a user to steady themselves during exercise or use. The system provides a more robust and long lasting solution to handle systems for trampolines.

19 Claims, 3 Drawing Sheets

(58) Field of Classification Search

CPC ..... A63B 26/003; A63B 69/0057; A63B 69/0064; A63B 71/0054; A63B 71/02; A63B 71/023; A63B 71/04; A63B 2071/0072; A63B 2071/026; A63B 2071/027; A63B 2208/02; A63B 2208/0204; A63B 2208/0209; A63B 2210/00; A63B 2210/50; A63B 2225/09; A63B 2225/093

See application file for complete search history.

(56) References Cited

U.S. PATENT DOCUMENTS

| | | | | | |
|---|---|---|---|---|---|
| 4,489,933 | A | | 12/1984 | Fisher et al. | |
| 4,598,905 | A | | 7/1986 | Vrana | |
| 4,730,826 | A | * | 3/1988 | Sudmeier | A63B 5/11 482/28 |
| 4,824,100 | A | * | 4/1989 | Hall | A63B 5/11 482/28 |
| 4,836,530 | A | * | 6/1989 | Stanley, Jr. | A63B 5/11 482/27 |
| 5,374,225 | A | * | 12/1994 | Wilkinson | A63B 5/11 482/114 |
| 5,527,253 | A | * | 6/1996 | Wilkinson | A63B 22/0012 482/146 |
| 5,533,948 | A | | 7/1996 | Wilkinson | |
| 5,607,377 | A | * | 3/1997 | Wilkinson | A63B 5/11 482/27 |
| 5,634,870 | A | | 6/1997 | Wilkinson | |
| 5,645,510 | A | * | 7/1997 | Wilkinson | A63B 5/11 482/27 |
| D384,115 | S | * | 9/1997 | Wilkinson | D21/668 |
| 5,947,870 | A | * | 9/1999 | Hall | A63B 5/11 482/27 |
| 6,162,061 | A | | 12/2000 | Taylor | |
| D742,467 | S | * | 11/2015 | Giorgi | D21/797 |
| 2005/0130804 | A1 | | 6/2005 | Hall | |
| 2005/0209053 | A1 | * | 9/2005 | Knox | A63B 5/11 482/27 |
| 2006/0172861 | A1 | * | 8/2006 | Wang | A63B 5/11 482/27 |
| 2006/0223676 | A1 | * | 10/2006 | Rote | A63B 5/11 482/27 |
| 2011/0059816 | A1 | * | 3/2011 | Campanaro | A63B 65/06 473/435 |
| 2012/0018249 | A1 | * | 1/2012 | Mehr | A63B 69/0064 182/5 |
| 2013/0210590 | A1 | * | 8/2013 | Publicover | A63B 5/11 482/110 |
| 2014/0024509 | A1 | | 1/2014 | Gerschefske et al. | |

FOREIGN PATENT DOCUMENTS

| | | |
|---|---|---|
| GB | 2 428 596 | 2/2007 |
| KR | 20-2009-0005980 | 6/2009 |

OTHER PUBLICATIONS

International Search Report dated Apr. 7, 2015 issued in PCT International Patent Application No. PCT/GB2014/000423, 4 pp.

International Preliminary Report on Patentability dated Feb. 21, 2017 issued in PCT International Patent Application No. PCT/GB2014/000423, 8 pp.

* cited by examiner

TRAMPOLINE SUPPORT HANDLE SYSTEMS

This application is the U.S. national phase of PCT International Application No. PCT/GB2014/000423 filed Oct. 17, 2014 which designated the U.S. and claims priority to Great Britain Patent Application No. 1414493.5 filed Aug. 15, 2014, the entire contents of each of which are hereby incorporated by reference.

FIELD OF THE INVENTION

The present invention relates to the use of trampolines in particular smaller versions that are used for exercise and fitness and their support handles.

BACKGROUND

The use of trampolines for exercise and fitness routines has been popular on a global status for many years. Since the basic trampoline was invented or first used in public in 1936 its progress has been gradual but successful. These have developed into small versions of traditional trampolines some of which have handles that attached to the legs or frame. These have presented issues over recent years by breaking or becoming damaged during use. Due to the way that the known handles are attached, the constant movement and pressure on the handle provides wear on the area where it is clamped onto the leg and often breaks, which can be dangerous.

The history of the trampoline extends from Nissen was a gymnastics and diving competitor and Griswold was a tumbler on the gymnastics team, both at the University of Iowa, USA. They had observed trapeze artists using a tight net to add entertainment value to their performance and experimented by stretching a piece of canvas, in which they had inserted grommets along each side, to an angle iron frame by means of coiled springs. It was initially used to train tumblers but soon became popular in its own right. Nissen explained that the name came from the Spanish trampolin, meaning a diving board. George Nissen had heard the word on a demonstration tour in Mexico in the late 1930s and decided to use an anglicized form as the trademark for the apparatus. In 1942, Griswold and Nissen created the Griswold-Nissen Trampoline & Tumbling Company, and began making trampolines commercially in Cedar Rapids, Iowa. The generic term for the trademarked trampoline was a rebound tumble and the sport began as rebound tumbling.

It has since lost its trademark and has become a generic trademark. Using a trampoline can be dangerous, and in organized clubs and gyms there are usually large safety end-decks with foam pads at each end and spotters placed alongside the trampoline to try to break the fall of any athlete who loses control and falls.

The majority of injuries occur on privately owned home trampolines. Bouncing off a trampoline can result in a fall of 3-4 meters (10-13 ft) from the peak of a bounce to the ground or a fall into the suspension springs and frame. The handles on smaller trampolines often break during use, due to the known way in which they are attached. There has been an increase in the number of home trampolines in recent years and a corresponding increase in the number of injuries reported, leading some medical organizations to suggest that they be banned. Authorities recommend that only one person should be allowed to jump at a time to avoid collisions and people being catapulted in an unexpected direction or higher than they expect. In fact, one of the most common sources of injury is when there are multiple users bouncing on the trampoline at one time. More often than not, this situation leads to users bouncing into one another and thus becoming injured; many suffer broken bones as a result of landing strangely after knocking into another user.

Another of the most common sources of serious injury is an attempt to perform somersaults without proper training. In some cases, people land on their neck or head, which can cause paralysis or even death. A famous incident in the 1960s paralyzed pole-vaulting champion Brian Sternberg from the neck down.

Danger can be reduced by burying the trampoline so the bed is closer to the surrounding surface to lessen falling distance, and padding that surrounding area. Pads over the spring and frame reduce the severity of impact injuries. Keeping the springs covered also reduces the risk of a limb falling between the gaps in the springs and the rest of the body falling off of the trampoline.

Kits are available for home trampolines that provide a retaining net around the trampoline and prevent users from bouncing over the edge, these include nets and coverings and attached handles. The American Academy of Pediatrics states that there is no epidemiological evidence that these improve safety. The nets do prevent jumpers falling off the trampoline onto the ground, these falls are not the most common source of injury and multiple users bouncing in a netted trampoline can still be injured. This would have a larger benefit for safeguarding solo trampolinists, so long as they avoid falling on their head/neck.

Having some training in a gym may be beneficial in alerting people to possible hazards and provide techniques to avoid bad falls.

Family-oriented commercial areas in North America such as shopping centres, carnivals, and so on, often include closed inflatable trampolines (CITs) as a children's attraction. These have safety nets on the sides to prevent injuries.

A mini-trampoline (also known as a rebounder, trampette, jogging trampoline, or exercise trampoline) is less than 1 meter (3 ft 3 in) in diameter and about 30 centimeters (12 in) off the ground, often kept indoors and used as part of a physical fitness regime.

So-called rebounding provides a form of exercise with a low impact on knees and joints. Mini-trampolines do not give a rebound as high as larger recreational or competitive trampolines.

These mini versions provide use for fitness and are often provided with handles attached to them.

The requirement for a handle on these smaller examples, relates more to the user standing vertically and bouncing or rebounding up and down or in forward or backward varying motion and requiring a handle or steadying bar to hold to remain in the correct position for their exercise routine.

Known examples may often attach to the short supporting legs of the trampoline using direct location and clamping or various types.

However, owing to the primitive nature of this known design and the repeated stress applied to the attachment point during usage, the legs or collar used for attachment often break away from the frame of the trampoline or other related damage occurs rendering the equipment unusable.

The present invention discloses an improved method of attaching a handle arrangement that will perform more in line with the requirements of the user and not damage the support legs or other related areas of the trampoline.

PRIOR ART

Accordingly patent applications have been filed to provide general solutions, including the following:

United States patent ref: U.S. Pat. No. 5,635,870 (WILKINSON)

Discloses a handle arrangement that is attached to a rebound platform or trampoline 'type' unit. These handles may move in a forward or backward manner to aid exercise. They are attached to the frame of the subject.

United States patent ref: U.S. 2014/0024509 (BARUFKA)

Discloses a larger trampoline with a tubular type frame that passes underneath an exercise unit and acts as a supporting method for it. This unit includes a foot based rebound section.

SUMMARY OF THE INVENTION

According to the present invention there is provided a mini or smaller trampoline that is provided in the known way with several short tubular legs that are attached to the circular underside frame of the trampoline, by methods that include a screw threaded method.

The present invention is attached by utilising these existing short tubular trampoline legs, by having its own tubes, that may be referred to for explanatory purposes at 'female or receiving tubes'.

These tubes are hollow and are of a slightly larger diameter on their interior than the exterior diameter of the 'male' tube of the short tubular trampoline legs.

The short trampoline legs are inserted into the slightly larger hollow receiving tubes of the invention, which provides at least three (3) receiving tubes that correspond in their position with those of the short trampoline legs, to a measurement that would enable usage of the invention with all or most known small or mini trampolines and their leg spacing's thus.

The rubber feet of the trampoline short legs may be removed prior to installation into the receiving female tubes.

The three receiving tubes of the invention, are suitably located to correspond with the position of the trampoline legs, and are attached vertically to a 'T' or variably shaped flat steel or metal variant holding frame.

This holding frame and its general 'T' form rests fully to the ground with the three hollow receiving tubes presented vertically from its surface upwardly.

The front extend of the 'T' shape or variant form is a fourth ($4^{th}$) much longer receiving tube, directly aside one of the receiving tubes that stands in the frontal position to the trampoline when in place.

This fourth ($4^{th}$) larger vertically standing receiving tube may be of exacting or differing diameter to that of the 3 or more receiving tubes for the trampolines legs.

This fourth tube is longer as it is for the long extending handle to be inserted therein.

The 3 legs or more of the mini trampoline are inserted into the corresponding hollow tubes of the invention as it lays on the ground, all legs are vertical. The legs of the trampoline are inserted until they come to rest on the sealed ends of the receiving tubes fully.

To the length of the leg receiving tubes are holes, they pass through fully to allow a threaded holding pin or an unthreaded slot pin to be inserted to retain the internally slotted legs in lace within the hollow receiving tubes. This is due, in the known way, to the threaded or none threaded bars gaining purchase with the housed legs outer surface and holding it.

This holding method also is provided for the longer vertical receiving tube which houses an inserted long bar with the holding handle to its top.

It may be presented that this longer tube may have holes that pass through it entirely and also through correspondingly located through holes in the inserted long handle bar. Thus a single slot pin can be passed through the two holes once they are aligned to hold the handle and its bar in place, once the desired height for the person has been achieved or selected.

Once in place the invention and its 'T' shape or variable form is located underneath the mini trampoline and rest on the ground or floor. It may have rubber or mounting feet to its underside, providing they allow sufficient locating of the legs and receiving tubes.

Once the trampoline is in use, the user will hold the long vertically mounted handle and bar, adjustable as described, in their hands.

As they rebound or bounce on the mini trampolines surface, carrying out exercise routines, they hold the handle to steady themselves.

Due to the legs of the trampoline being inserted into the three or more receiving tubes of the invention, they are held during use. The legs are unable to 'raise' within the receiving tubes due to them being of suitable fit and held by threaded or none threaded inserted pins or screw arrangements.

The nature of the 'T' shaped or variable form base of the invention, equates to an even spread of the pressure and stress delivered from the weight or wanting movement of the mini trampoline and any movement of the handle, over the three receiving tubes and their inserted legs, thus preventing the breakage that is common in known handle mountings. This design therefore provides a method that is rapid to apply and effective in maintaining the position of the mini trampoline once in use, being able to counter balance any wanting movement created by the users body weight shift on the mini trampoline as they exercise. It may be stated that the width of the handle which the user holds or grips during use would possibly affect the stability of the trampoline and any wanting movement, thus the handles width should be restricted to sizes or lengths that are within a determinable measurement, well within the width of the mini trampolines diameter.

The 'T' shape or variable form of the invention is determined by the fact that it has to hold at least three (3) vertical hollow receiving tubes to the same position of the legs that are extending from the underside of the mini trampoline.

Thus the shape or form of the invention has been determined initially by its function requirement.

The 'T' shape provides a suitable metal, or similar composite material, frame which lays on the ground or floor and presents the 3 (three) or more vertical receiving tubes and the longer vertical hollow housing for the inserted handle tube or bar.

Therefore, providing the main area that is provided by the 'T' shape is still provided, other shapes may be incorporated to form the invention frame.

For example, a circular shape, to the centre of the 'T' frame or shaped or themed frame lengths to provide the same outcome.

The presented invention herein provides a solid and successful frame to hold the mini trampoline and provide a handle for the user but it may be possible to add forms or shaping to the invention 'T' frame and improve stability or novelty of use.

This invention may or may not be exclusive to mini or any other size of trampoline or other similar exercise device or other device onto which people may stand.

DETAILED DESCRIPTION OF FIGURES

Figure 1:
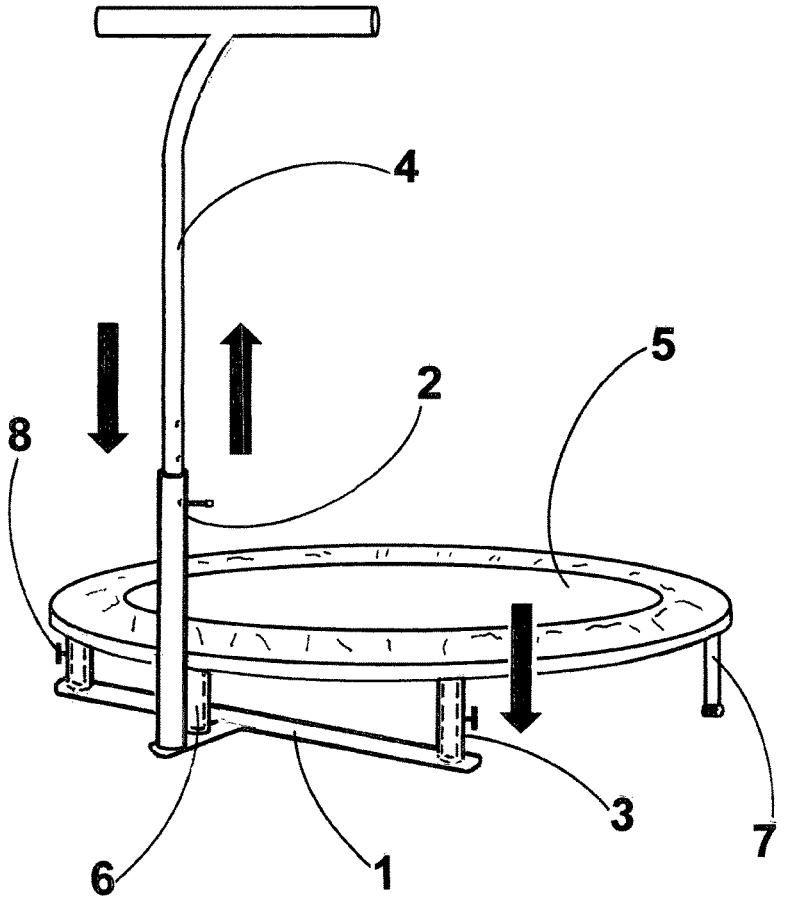
FIG. 1 show an example of the trampoline support handle system installed onto a mini trampoline.

A typical embodiment of the invention is illustrated in FIG. 1. This shows the holding frame 1 located beneath the trampoline 5. The trampoline legs 7 are inserted in unison into the leg housing tube 3, leg shown seated inside 6.

These may be secured using a threaded tube securing screw 8. A handle housing tube 2 has an extending handle 4, inserted into its hollow interior, which may also be held at chosen heights using a slot through securing pin, as shown in FIG. 1.

Figure 2:
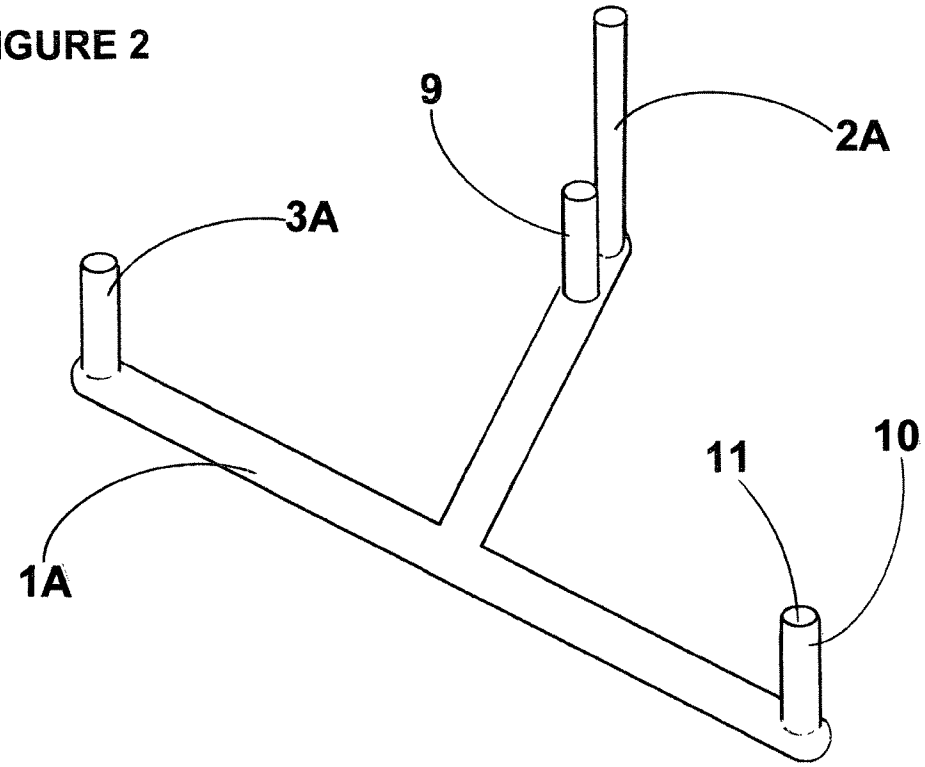
FIG. 2 show an example of the trampoline support handle system in a dimensional view.

The holding frame 1A, as shown in FIG. 2 is of a relative form to present suitable located and spaced vertical hollow receiving tubes, 2A, 3A, 9 and 10.

These hollow receiving tubes house the legs of the trampoline in 3A, 9 and 10. This provision is possible by the hollow interior, shown as one example in 10 as 11.

The longer extending handle is inserted and held at chosen heights inside 2A.

As shown in FIG. 2.

Figure 3:
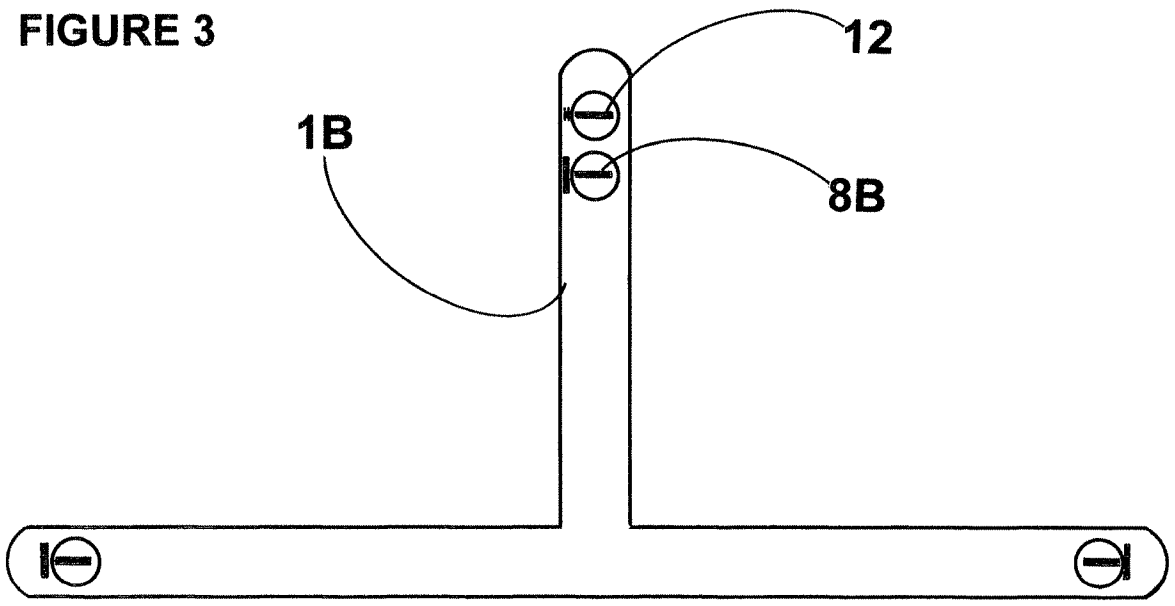
FIG. 3 show an example of the trampoline support handle system in a plan view.

A plan view of the invention without the extending handle is shown in FIG. 3, 1B.

Securing bolts 8B, which may be threaded are shown as is a slot pin 12, to retain the trampoline legs once inserted therein.

The invention claimed is:

1. A trampoline support handle apparatus comprising:

a base having a first lateral side portion comprising a first leg connector arranged for connection to a first leg of a trampoline, a second lateral side portion comprising a second leg connector arranged for connection to a second leg of the trampoline, and a central portion, wherein the first and second lateral side portions are aligned along and define a transverse axis of the base, and wherein the first and second lateral side portions and the central portion are configured to rest fully on a ground surface to provide lateral and longitudinal support for the trampoline support handle apparatus; and a trampoline support handle securable to the base and comprising a grip portion in the form of a bar extending in opposite directions from a middle region along a longitudinal axis, wherein the longitudinal axis is substantially parallel to the transverse axis, and wherein the middle region is aligned with and vertically spaced apart from the central portion such that the grip portion is disposed centrally with respect to the transverse axis.

2. The trampoline support handle apparatus of claim 1, wherein the grip portion is disposed intermediate the first leg connector and the second leg connector.

3. The trampoline support handle apparatus of claim 1, wherein the trampoline support handle is securable to the central portion.

4. The trampoline support handle apparatus of claim 3, wherein the central portion comprises a front portion and a rear portion.

5. The trampoline support handle apparatus of claim 4, wherein the trampoline support handle is securable to the front portion.

6. The trampoline support handle apparatus of claim 5, wherein the trampoline support handle is configured such that the grip portion of the trampoline support handle is disposed above the rear portion when the trampoline support handle is secured to the base.

7. The trampoline support handle apparatus of claim 1, wherein the central portion comprises a handle socket for receiving a part of the trampoline support handle.

8. The trampoline support handle apparatus of claim 7, wherein the part of the trampoline support handle comprises a stem portion which is slidably received by the handle socket.

9. The trampoline support handle apparatus of claim 1, wherein the trampoline support handle is detachable from the base.

10. The trampoline support handle apparatus of claim 1, wherein the first leg connector comprises a first socket for receiving the first leg of the trampoline and the second leg connector comprises a second socket for receiving the second leg of the trampoline.

11. The trampoline support handle apparatus of claim 10, wherein each of the first and second sockets comprises a tube which extends upwardly when the base is placed on the ground surface when the ground surface is substantially level.

12. The trampoline support handle apparatus of claim 1, wherein the base has a substantially planar lower surface.

13. The trampoline support handle apparatus of claim 1, wherein the base has a general 'T' form.

14. The trampoline support handle apparatus of claim 1, wherein the central portion comprises a third leg connector connectable to a third leg of the trampoline.

15. The trampoline support handle apparatus of claim 14, wherein the first, second and third leg connectors are spaced apart from each other about a circumference of a predefined circle.

16. The trampoline support handle apparatus of claim 1, wherein the base is configured for connection to the trampoline, wherein the trampoline is a single trampoline.

17. A trampoline apparatus comprising:

a base having a first lateral side portion comprising a first leg connector, a second lateral side portion comprising a second leg connector, and a central portion, wherein the first and second lateral side portions are aligned along and define a transverse axis of the base;

a trampoline support handle securable to the base and comprising a grip portion in the form of a bar extending in opposite directions from a middle region along a longitudinal axis, wherein the longitudinal axis is substantially parallel to the transverse axis, and wherein the middle region is aligned with and vertically spaced apart from the central portion such that the grip portion is disposed centrally with respect to the transverse axis; and a trampoline having a plurality of support legs comprising a first support leg which is connectable to the first leg connector and a second support leg which is connectable to the second leg connector;

wherein the first and second lateral side portions and the central portion are configured to rest fully on a ground surface to provide lateral and longitudinal support for the trampoline support handle, and wherein the grip portion is disposed directly above the trampoline when the trampoline support handle and the trampoline are connected to the base.

18. The trampoline apparatus of claim 17, wherein the trampoline comprises a rigid external frame and the plurality of support legs are fixed to the rigid external frame.

19. The trampoline of claim 17, wherein a number of support legs of the trampoline exceeds a number of leg connectors of the base and the trampoline is connected to the base such that at least one of the plurality of support legs other than the first and second support legs of the trampoline is directly in contact with the ground surface on which the base is supported.

* * * * *